United States Patent [19]

Collins et al.

[11] Patent Number: 4,749,382

[45] Date of Patent: Jun. 7, 1988

[54] STABLE OIL DISPERSIBLE METAL SALT SOLUTIONS

[75] Inventors: John H. Collins, Carol Stream; Marcos Y. Corpuz, Lisle; George T. Kekish, Naperville; Larry P. Koskan, Orland Park, all of Ill.

[73] Assignee: Nalco Chemical Company, Oak Brook, Ill.

[21] Appl. No.: 573,090

[22] Filed: Jan. 23, 1984

Related U.S. Application Data

[63] Continuation-in-part of Ser. No. 316,097, Oct. 29, 1981, abandoned.

[51] Int. Cl.[4] ..... C10L 1/18

[52] U.S. Cl. ..... 44/53; 44/68; 44/71; 44/77; 44/79

[58] Field of Search ..... 44/68, 78, 79, 71, 2, 44/53, 77; 252/309; 110/343, 344, 345

[56] References Cited

U.S. PATENT DOCUMENTS

| | | | |
|---|---|---|---|
| 2,086,775 | 7/1937 | Lyons et al. | 44/9 |
| 2,151,432 | 3/1939 | Lyons et al. | 44/9 |
| 2,460,700 | 2/1949 | Lyons | 44/68 |
| 2,673,145 | 3/1954 | Chandler | 44/67 |
| 2,819,228 | 1/1958 | Dell et al. | 252/309 |
| 3,002,826 | 10/1961 | Norris | 44/68 |
| 3,366,673 | 1/1968 | Wakeman et al. | 44/71 |
| 3,639,109 | 2/1972 | Badin | 44/68 |
| 4,022,699 | 5/1977 | Holm | 252/309 |
| 4,169,170 | 9/1979 | Doeksen | 44/6 |
| 4,264,333 | 4/1981 | Shaw et al. | 44/6 |
| 4,331,445 | 5/1982 | Burns | 44/6 |
| 4,369,719 | 1/1983 | Engstrom et al. | 110/343 |

FOREIGN PATENT DOCUMENTS

| | | |
|---|---|---|
| 823202 | 2/1975 | Belgium . |
| 1378882 | 2/1971 | United Kingdom . |

OTHER PUBLICATIONS

U.S. Ser. No. 289,219, filed 8/03/81.

Sisley, "Encyclopedia of Surface Active Agents", 1952, p. 97.

*Primary Examiner*—Jacqueline V. Howard

*Attorney, Agent, or Firm*—John G. Premo; Donald G. Epple; Robert A. Miller

[57] ABSTRACT

An oil-dispersible, water-based fuel additive is disclosed. The fuel additive comprises a metal salt solution, selected from the group comprising, an alkaline-earth metal salt from the II-A group of the periodic table of the elements, a transition-metal salt, a cationic surfactant, a solubilizing agent, and a stabilizing agent.

7 Claims, No Drawings

STABLE OIL DISPERSIBLE METAL SALT SOLUTIONS

This application is a continuation-in-part of the copending application Ser. No. 316,097 filed on Oct. 29, 1981, now abandoned.

BACKGROUND OF THE INVENTION

This invention relates to fuel additives for use in large oil-burning furnaces. More specifically, the invention relates to fuel treatment additives useful in reducing boiler fire-side and air heater corrosion, reducing slag formation, facilitating slag deposit removal, and improving fuel combustion efficiency.

As is well known in the combustion art, slag particles form deposits on various surfaces along the combustion path within a furnace. It has been theorized that slag deposits form mainly because of impurities present in the fuel. However formed, these deposited slag particles catalyze known oxidation reactions, such as $SO_2$ to $SO_3$. Most furnace fuels contain a variety of sulfur-bearing compounds, because it is not economically feasible to remove such compounds before the fuel is fed to the furnace.

A known product of combustion is water vapor. It is well known that gaseous $H_2O$ and gaseous $SO_3$ chemically combine to form $H_2SO_4$. As the gaseous $H_2SO_4$ concentration builds up in a combustion furnace, the $H_2SO_4$ dew point is increased. Slag acts as an absorbent for the condensing $H_2SO_4$, thereby aggravating low-temperature corrosion problems. Furnace slag particles are impregnated with condensed $H_2SO_4$, and such impregnated deposits can cause significant damage to metallic boilers and other surfaces. Sulfuric acid is not the sole acid formed within combustion furnaces. Other, equally corrosive, acids form and can cause furnace damage through a variety of corrosion mechanisms.

Another well known effect of slag formation inside combustion furnaces is the reduction of furnace heat exchange efficiencies. Reduced efficiencies arise because slag acts as an insulator: its presence on a heat transfer surface reduces the effective rate of heat transfer through that surface.

Generally, slag has a low fusion temperature, and quite often while in a molten state, impacts upon heat exchange surfaces and adheres there. Upon adhering, the molten slag is cooled by the relatively cooler metal of the heat exchange surface and becomes solidified. Such adhering slag can thereafter entrain additional molten slag particles and eventually builds up to become a tenacious deposit.

It is known that certain fuel oil additives interfere with slag formation on furnace surfaces. It has been theorized that such interference is essentially a metal deposition mechanism. For example, certain fuel oil additives furnish a particular metal form of a chemical species at the flame zone of a combustion furnace. Such a chemical species, generally possessing a low energy of activation, then thermally decomposes, thereby furnishing the combustion surface with the deposited active form of a particular metal. The deposited metal then beneficially interferes with the slag formation at the combustion surface. Because of this metal deposition mechanism, the resultant slag is much more friable, does not build up significantly at combustion surfaces, and is likely to be carried off by convective currents within the furnace.

A variety of fuel oil additives, designed to alter or beneficially interfere with slag formation, are known in the art. However, some of these additives are necessarily dual-phase by nature. Prior to the present invention, both an aqueous phase and a continuous oil phase had been required to inject water metal salt solutions into fuel oil.

Dual-phase fuel additives do not disperse well when added to liquid fuels. The poor dispersion of the fuel additive very often results in numerous field problems, such as fouling of oil filters, strainers, and burner surfaces. Such poor dispersion may be caused primarily by the high viscosity of such fuel additives.

In addition to exhibiting poor dispersion qualities, such dual-phase fuel additives are not cost efficient. The active ingredient is generally a water soluble salt. Because these salts are generally dispersed in oil when sold, the dispersed product is necessarily more costly because of the presence of the required oil phase. The present invention is much more cost efficient because no so-called oil phase is required in the commercially available form of the invention. Also, the manufacturing requirements are considerably simplified further lowering cost.

The general concept of a so-called single phase, water-based, salt solution is not new to those skilled in the art. However, prior to the present invention, such products were not commercially useful because they failed to disperse in fuel oil, and, after relatively short periods of time, became unstable.

It is an object of the present invention to provide a completely water soluble fuel oil additive designed to reduce slag formation and increase combustion efficiency. It is also an object to provide such a fuel oil additive which is highly dispersible in fuel oil. It is likewise an object to provide such a fuel oil additive which is stable during storage at storage temperatures which, by way of example, can range from approximately −28.9° centigrade (−20° fahrenheit) to approximately 48.9° centigrade (120° fahrenheit). It is likewise an object to provide such a fuel oil additive that is dispersible in fuel oil and when dispersed is stable with oil for at least 45 days and up to one year.

SUMMARY OF THE INVENTION

In accordance with the invention, an additive has been formulated which interferes with slag formation and increases combustion efficiency, yet which is dispersible in fuel oil and exhibits good dispersion stability.

The additives of this invention generally comprise the following four components:

1. Aqueous metal salt solution;
2. Cationic water soluble quaternary ammonium surfactant;
3. Stabilizing agents selected from the group consisting of $C_1$–$C_3$ alcohols; and
4. Solubilizing agents selected from the group consisting of mono and di ($C_1$–$C_4$) alkyl ethers of ethylene, diethylene and propylene glycols.

A particularly useful, practicable formulation of the oil-dispersible, water-based, fuel oil additive of the present invention is:

| Ingredient | Percentage, by weight |
|---|---|
| Aqueous Metal Salt Solution | 94.0 |

-continued

| Ingredient | Percentage, by weight |
|---|---|
| Barquat MB-80 | 1.0 |
| Tecsol A (95% ethyl alcohol) | 1.0 |
| Dowanol DB (ethylene glycol n-butyl ether) | 4.0 |
| Total Ingredients | 100.0 |

THE METAL SALT SOLUTIONS

Metal-salt solution formulations which have been successful in practicing the present invention are:

| Metal Salt | Percentage of salt in solution, by weight |
|---|---|
| $Ce(NO_3)_3$ | 54.7 |
| $BaCl_2$ | 30.0 |
| $MgCl_2$ | 32.0 |
| $Cu(NO_3)_2$ | 53.0 |
| $Mg(NO_3)_2$ | 66.7 |
| $Mn(NO_3)_2$ | 50.0 |
| $MnCl_2$ | 40.0 |
| $AlCl_3$ | 50.0 |
| $Al(NO_3)_3$ | 50.0 |
| $MgSO_4$ | 40.0 |
| $Ca(NO_3)_2$ | 66.0 |
| $CaCl_2$ | 30.0 |

These aqueous solutions were chosen because they are known to improve fuel combustion efficiency, reduce slag deposits and minimize fireside corrosion. The chloride, sulfate and nitrate salts were chosen because of their high metal content and relatively low cost.

The metal salts contained in these metal salt solutions are selected from the group consisting of:

(a) an alkaline-earth metal salt from group II-A group of the periodic table of the elements; or (b) a transition-metal salt.

As seen, the metal salt solutions useful in this invention will generally contain 15–60 percent by weight of the designated metal salt. This figure, however, is for example only, and the limits of solubility of the particular metal salt to be employed can be readily found using available tables or simily by routine experimentation. The metal salt solutions generally contain as much metal salt as can be dissolved in water, allowing for the fact that precipitation may occur when the solutions are cooled.

THE CATIONIC SURFACTANTS

The cationic water soluble quaternary ammonium surfactants useful in this invention are readily available from many commercial suppliers. These materials are generally alkyl dimethyl benzyl ammonium chlorides, or fatty dimethyl ammonium chlorides. Other surfactants will, of course, find utility in the subject invention, and the above description or specific chemical types is not meant to be limiting. Other quaternizing agents then those enumerated above can be above with success.

The preferred surfactant for use in this invention is "Barquat MB-80". This material is manufactured by Lonza Incorporated and is chemically classified as an alkyl dimethyl benzyl ammonium chloride quaternary amine. The alkyl hydrocarbon-based portion of this material is believed to comprise approximately 40% $C_{12}$, approximately 50% $C_{14}$, and approximately 10% $C_{16}$, on a weight basis. Lonza Incorporated has offices in Rolling Meadows, Ill., and elsewhere.

In addition to Barquat MB-80, the following quaternary amine cationic surfactants have been found to emulsify the water-based salt solution in oil, and therefore can be useful in practicing the present invention:

| Ingredient, Trade Name | Chemical Classification |
|---|---|
| Barquat 4280 | Alkyl dimethyl ethyl benzyl ammonium chloride |
| Bardac LF | Dioctyldimethyl ammonium chloride |

The two above named cationic surfactants are manufactured and offered commercially by Lonza Incorporated.

Of the tested cationic surfactants, useful working ranges as to the alkyl hydrocarbon-based portions comprise about 20% to about 60% $C_{12}$, about 30% to about 70% $C_{14}$, and about 5% to about 15% $C_{16}$, and about 0% to about 5% $C_{18}$ on a weight basis.

Many other nonquaternary cationic surfactants have been tested for use in this present invention but have not been found useful in meeting the objects of the present invention.

The quaternary surfactants of the subject invention may also be categorized according to the length of the alkyl group. Generally a quaternary surfactant having from 8–21 carbon atoms, exclusive of the quaternizing agent, will perform satisfactorily in this invention.

In the present invention, the quaternary amine cationic surfactant functions as the emulsifier. It is the key ingredient in dispersing the soluble metal salt solution in fuel oil.

THE STABILIZING AGENT

The next important ingredient useful in the formation of the compositions of this invention is the stabilizing agent. This material is believed to increase the stability of the metal salt solutions at high temperatures (>100° F.), and is selected from the group consisting of methyl, ethyl, propyl, isopropyl alcohols and mixtures thereof. A particularly preferred solubilizing agent is ethyl alcohol.

A particularly preferred material is Tecsol A, manufactured by Eastman Chemical Products, Incorporated, of Rochester, N.Y., and is chiefly ethyl alcohol.

THE SOLUBILIZING AGENT

The next ingredient useful in this composition is a solubilizing agent, generally selected from the group consisting of ethylene, diethylene, and propylene glycol mono and di $C_1$–$C_4$ alkyl ethers. Examples of suitable materials for the solubilizing agent include:

Ethylene glycol mono ethyl ether,
Ethylene glycol mono ethyl ether,
Ethylene glycol mono propyl ether,
Ethylene glycol mono butyl ether,
Ethylene glycol di methyl ether,
Ethylene glycol di ethyl ether,
Ethylene glycol di propyl ether,
Ethylene glycol di butyl ether,
Di ethylene glycol mono methyl ether,
Di ethylene glycol mono ethyl ether,
Di ethylene glycol mono propyl ether,
Di ethylene glycol mono butyl ether,
Di ethylene glycol di methyl ether,
Di ethylene glycol di ethyl ether, Di ethylene glycol di propyl ether,
Di ethylene glycol di butyl ether,
Propylene glycol mono methyl ether,
Propylene glycol mono ethyl ether,
Propylene glycol mono propyl ether,
Propylene glycol mono butyl ether,
Propylene glycol di methyl ether,
Propylene glycol di ethyl ether,
Propylene glycol di propyl ether,
Propylene glycol di butyl ether,
and mixtures thereof.

A particularly useful solubilizing agent in this invention is Dowanol DB, available for the Dow Chemical Company, which is a diethylene glycol n-butyl ether It is the theory of the inventor that the Tecsol A ingredient acts together with the Dowanol DB ingredient to solubilize the cationic surfactant, and that a resultant microemulsion or micellular solution exists.

While the major proportion of the composition will always be the aqueous metal salt solution previously described, variations in percentage levels of the other three ingredients is possible, and is likely to occur when working with different metal salt solutions, different cationic surfactants or different solubilizing or stabilizing agents. Accordingly, the compositions will generally contain from 75–99 percent by weight, preferably 80–98 percent and most preferably 90–96 percent by weight of the aqueous metal salt solution. Likewise, the composition may contain from 0.1–10 percent, preferably 0.5–5.0 percent and most preferably 0.6–2.5 percent of the water soluble cationic surfactant. Generally the composition will contain from 0.1–10 percent of the $C_1$–$C_3$ alkyl alcohol, preferably 0.5–5.0 percent and most preferably 0.6–2.5 percent. The composition will also contain 0.5–15 percent, preferably 1.0–7.0 percent, and most preferably 1.0–5.0 percent of the solubilizing agent.

Important in the preparation of the products of this invention is the ratio of the solubilizing agent to cationic surfactant. Preferably the weight ratio of solubilizing agent to surfactant should be at least 2:1, and most preferably at least 4:1.

The best present known mode of practicing the present invention comprises using (1) 32% $MgCl_2$, 53% $Cu(NO_3)_2$, 66% $Ca(NO_3)_2$, 66.7% $Mg(NO_3)_2$, 50.0% $Mn(NO_3)_2$, 40.0% $MnCl_2$, 50.0% $AlCl_3$, 50.0% $Al(NO_3)_3$, or 40.0% $MgSO_4$ aqueous solutions as the metal-salt solution ingredient, (2) an alkyl dimethyl benzyl ammonium chloride comprising (as the carbon-chain length requirements), approximately 20% to 60% (by weight) $C_{12}$, approximately 30% to 70% $C_{14}$, and approximately 5% to 15% $C_{16}$, as the cationic surfactant ingredient, (3) Dowanol DB, as the solubilizing ingredient, and (4) Tecsol A as the stabilizer ingredient.

A practical manufacturing procedure for the oil-dispersible, water-based, fuel oil additive of the present invention comprises (1) charging a mixing vessel with the appropriate volumetric quantity of a metal-salt solution ingredient, usually comprising (a) an alkaline-earth metal from the II-A group of the periodic table of the elements, or (b) a transition-metal salt; (2) then charging the mixing vessel with the appropriate volumetric quantity of the cationic surfactant ingredient; (3) then mixing for 30 minutes; (4) then charging the mixing vessel with the appropriate volumetric quantity of the solubilizing ingredient; (5) then mixing for 15 minutes; (6) then charging the mixing vessel with the appropriate volumetric quantity of the stabilizer ingredient; (7) then mixing for 60 minutes; and (8) then passing the resultant mixture through an in-line filter. In actual use, the filtered mixture is then injected through a quill into number 6 oil, residual oil, or waste oil streams prior to combustion of the oil. The fuel oil is either burned immediately or stored in a storage tank. Preferably, these oil dispersible water-based fuel additives should be injected before a shear device such as a centrifugal gear pump to ensure good dispersion. This is particularly important if the additive-oil mixture will be stored for a long time period.

These water-based, metal-salt solutions are rendered highly oil-dispersible by the presence of the appropriate cationic surfactant comprising appropriate hydrocarbon chain lengths. The unique oil dispersibility feature of the present invention enables injection and dispersion of metal-salt containing water droplets into fuel oil prior to combustion. Prior to the present invention, only oil soluble additives could be injected into oil and stored in the oil stroage tanks. Now, water-based solutions can be dispersed to a relatively small particle size (theoretically less than 10 microns in diameter). Such a small particle size provides extended stability in storage tanks (greater than 30 days, for example).

It will be appreciated that the usefulness of the water-based, metal salt solution fuel treatment additive feature of the present invention is not limited to dispersion in fuel oil. This invention can also be sprayed on coal and into the furnace section of boilers.

Having thus described our invention, we claim:

1. An oil-dispersible, water-based fuel oil additive comprising:

(A) an aqueous metal-salt solution selected from the group comprising:
  1. an alkaline-earth metal salt from the II-A group of the periodic table of the elements, or
  2. a transition-metal salt;

(B) a cationic quaternary water-soluble surfactant having an alkyl group, exclusive of the quaternizing agent of from 8–21 carbon atoms;

(C) a solubilizing agent selected from the group consisting of alkylene glycol mono and di $C_1$–$C_4$ alkyl ethers; and (D) a stabilizing agent selected from the group consisting of $C_1$–$C_3$ alkyl alcohols; said fuel oil additive being capable of remaining in stable dispersion in a fuel oil.

2. The oil dispersible, water-based fuel additive of claim 1 which contains:

(A) 75–99% by weight of an aqueous metal salt solution containing from 15% by weight to the limit of solubility of the designated metal salt;

(B) 0.1–10% of the cationic quaternary surfactant;

(C) 0.5–15% by weight of the solubilizing agent; and (D) 0.1–10% by weight of the alkyl alcohols with the provisio that the weight ratio of solubilizing agent to surfactant be at least 2:1.

3. The oil dispersible, water-based fuel additive of claim 1 wherein the metal salt solution is selected from the group consisting of aqueous solutions of the chloride sulfate and nitrate salts of magnesium, calcium, manganese, copper and aluminum.

4. The oil dispersible, water-based fuel additive of claim 1 wherein the cationic quaternary surfactant is an alkyl dimethyl benzyl ammonium chloride, such alkyl group containing from 8–21 carbon atoms.

5. The oil dispersible, water-based fuel additive of claim 1 wherein the solubilizing agent is diethylene glycol n-butyl ether.

6. A fuel oil containing a slag reducing amount of an oil dispersible, water-based fuel additive comprising:

(A) an aqueous metal-salt solution selected from the group comprising:

1. an alkaline-earth metal salt from the II-A group of the periodic table of the elements, or
2. a transition-metal salt;

(B) a cationic quaternary water-soluble surfactant having an alkyl group, exclusive of the quaternizing agent of from 8–21 carbon atoms;

(C) a solubilizing agent selected from the group consisting of alkylene glycol mono and di $C_1$–$C_4$ alkyl ethers; and (D) a stabilizing agent selected from the group consisting of $C_1$–$C_3$ alkyl alcohols; said fuel additive after being added to the fuel oil remaining in stable dispersion in such fuel oil.

7. The fuel oil of claim 6 wherein the oil-dispersible, water-based fuel additive comprises:

(A) an aqueous metal-salt solution selected from the group comprising:

1. an alkaline-earth metal salt from the II-A group of the periodic table of the elements, or
2. a transition-metal salt;

(B) a cationic quaternary water-soluble surfactant having an alkyl group, exclusive of the quaternizing agent of from 8–21 carbon atoms;

(C) a solubilizing agent selected from the group consisting of alkylene glycol mono and di $C_1$–$C_4$ alkyl ethers; and (D) a stabilizing agent selected from the group consisting of $C_1$–$C_3$ alkyl alcohols.

* * * * *